United States Patent [19]

Rogers, Jr.

[11] 3,970,078

[45] July 20, 1976

[54] HAND ROLLER MASSAGE DEVICE

[76] Inventor: Charles G. Rogers, Jr., 5201 Roosevelt St., Hollywood, Fla. 33021

[22] Filed: Mar. 10, 1975

[21] Appl. No.: 556,725

[52] U.S. Cl. ..... 128/57
[51] Int. Cl.[2] ..... A61H 15/00
[58] Field of Search ..... 128/57, 24.3, 67, 69, 128/24.4, 60

[56] References Cited

UNITED STATES PATENTS

| | | | |
|---|---|---|---|
| 602,950 | 4/1898 | Lau | 128/57 X |
| 872,126 | 11/1907 | Hart | 128/57 X |
| 1,533,528 | 4/1925 | Weaver | 128/57 |
| 1,872,832 | 8/1932 | Silverberg | 128/57 |
| 2,787,261 | 4/1957 | McDonald et al. | 128/24.3 |
| 2,944,543 | 7/1960 | Newcombe | 128/57 X |
| 3,756,224 | 9/1973 | Laymon | 128/57 |

*Primary Examiner*—Lawrence W. Trapp
*Attorney, Agent, or Firm*—Gustave Miller

[57] ABSTRACT

This device is a massage roller having a broad rim with tapering sides in which are located alternate series of curved ridges and of rectangular based pyramids and pyramid peaks. A plane resting on two adjacent pyramid peaks would be somewhat spaced from the intermediate curved ridge. A roller handle frame is shaped somewhat like a capital letter D lying on its flat side. The curved upper side has four finger fitting recesses on its under side, providing a hand fitting handle. The bottom flat side provides an elongate chassis having an axle at each end extending on opposite sides, there thus being four rollers supported by the frame. Lightening grooves are provided along opposite sides of each elongate portion including the chassis, the curved handle and the connecting stanchions at each end between the handle and the chassis. The entire frame and rollers may be of rigid molded plastic for light weight, but also may be entirely of a suitable metal or other material. The handle is of a convenient size to be grasped by one hand to roll the massage rollers over fleshy and fat or "cellulite" areas of a human body to knead and manipulate the flesh and fat and thus break down the gel-like lumps of cellulite and dissipate them through normal body circulatory functions. In addition, it massages, tones and strengthens the body as it is rolled thereover, and is also used for this function alone.

11 Claims, 11 Drawing Figures

HAND ROLLER MASSAGE DEVICE

OBJECTS OF THE INVENTION

It is an object of this invention to provide massage rollers having a comparatively broad rim, the rim having alternate series of projecting ridges thereon, one series being curved in peripheral cross section, the other intermediate series being rectangular base pyramids tapered from the rim to a slightly rounded peak at a distance slightly greater than a tangent plane between two adjacent curved ridges.

A further object of this invention is to provide an integral molded roller frame, preferably of ridged plastic material, metal or suitable material, which is preferably light in weight.

A still further object of this invention is to provide a molded one-piece roller frame wherein the frame is shaped somewhat like a capital letter D lying on its flat side, such flat side providing a chassis from which the opposite ends of axles protrude on which the massage rollers are journaled.

A yet further object of this invention is to provide a molded frame shaped like a capital letter D lying on its flat side wherein the upper curved side provides a hand fitting handle that has finger fitting recesses on its bottom, and the bottom flat side provides a chassis from the opposite ends of which an axle extends in opposite directions for journaling the massage rollers thereon, and wherein the axle may be integrally molded with the chassis, or alternately may be a separate axle extending transversely therethrough, either of plastic or of metal.

A further object of this invention is to provide a hand rolled massage device that is to be grasped by one hand and rolled over various fleshy and fat areas of the human body to exercize such body areas and cause them to be reduced.

Yet a further object of this invention is to provide a hand held body massaging roller device suitable for kneading and toning fleshy areas of the human body.

Yet a further object of this invention is to provide an improved but comparatively inexpensive massage device for rolling over and reducing the gel-like lumps of protuberant fat, that stick to the waist, thighs, knees, arms and buttocks and elsewhere, such as lumps known as "cellulite".

Yet a further object of this invention is to provide a massage roller or wheel which is provided with alternate high and low protuberances on its rim so that as it is rolled over the human body, it kneads and massages the lumps of fat or cellulite thereon, as well as exercizing and toning the flesh.

Yet a further object of this invention is to provide a novel massage roller frame that is conveniently hand fitting, that is easy to hold and manipulate, that is very light in weight, preferably less than three quarters of a pound, and can be manipulated readily over almost all areas of one's own body by the individual operator.

A still further object of this invention is to provide a hand roller massage device that may have a unitary frame providing a convenient hand grip as well as a chassis with axle means on which the rollers are journaled.

Still a further object of this invention is to provide a novel improvement over all the prior art, including U.S. Pat. Nos. 1,663,975; 2,572,627; 3,060,928; 3,756,224, amongst others.

DESCRIPTION OF THE FIGURES

With the foregoing and other objects in view, this invention comprises the combinations, construction and arrangements of parts hereinafter set forth, claimed and disclosed in the accompanying drawing, in which:

Figure 9:
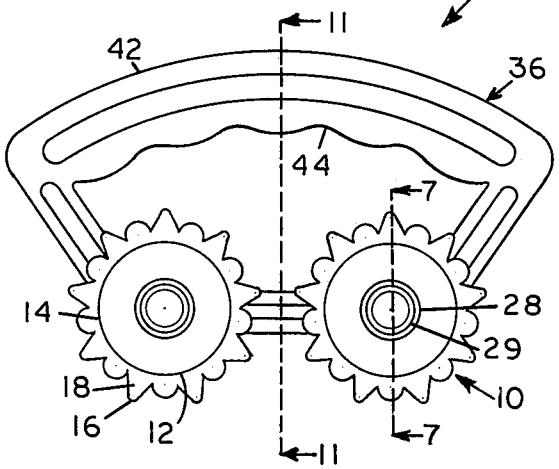
FIG. 9 is an elevational side view of the hand roller massage device assembly utilizing the rollers of this invention.

There is shown at 10 the massage roller which is the essence of this invention. This roller 10 has a broad rim 12 tapered inwardly and upwardly from its opposite peripheral edges 14. Alternate series of curved ridges 16 and intermediate rectangular base pyramids 18 and peaks 20 extend upwardly from this tapered rim 12, the pyramids 18 terminating in the slightly rounded peaks 20 which extend so far above the curved ridges 16 that a plane tangent to the two adjacent curved ridges 16 would be penetrated by the peaks 20. It will be noted that there are an odd number of curved ridges 16 and pyramids 18, so that each pyramid 18 and peak 20 is diamterically opposite a curved ridge 16. Extending inwardly from the rim 12 are four spokes 22 integrally connected to a hub 24 also secured to the rim 12 by an integral outer disk face 26. The disk face 26 is recessed at 28 where it is connected to the hub 24 so as to provide space for countersinking a cap nut 29 on an axle 30 or on an axle stub 32. The axle 30 extends through both ends of an elongate chassis 34 of a handle frame 36, and may be of metal or of the same material as the material of the handle frame 36, which material is preferably, but not necessarily, of a ridged molded plastic, and the rollers 10 are also preferably but not necessarily of the same ridged, molded plastic material.

Figure 10:
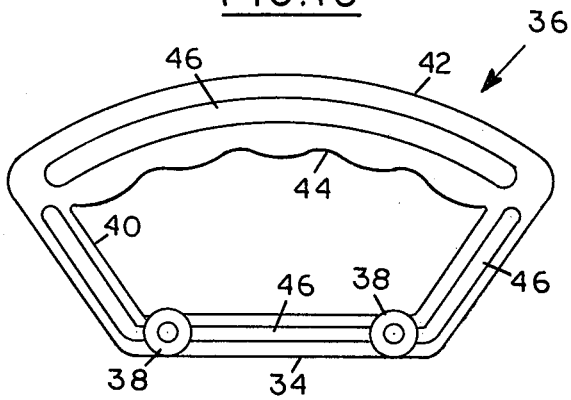
FIG. 10 is an elevation of the frame of FIG. 9.
Figure 11:
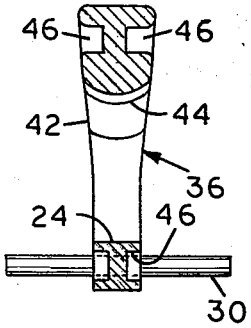
FIG. 11 is a section on line 11—11 of FIG. 9, but omitting the rollers on the axle and showing a one-piece axle.
Figure 7:
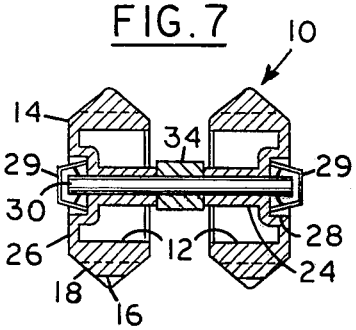
FIG. 7 is a section on line 7—7 of FIG. 9, including a one-piece axle for the massage rollers.
Figure 8:
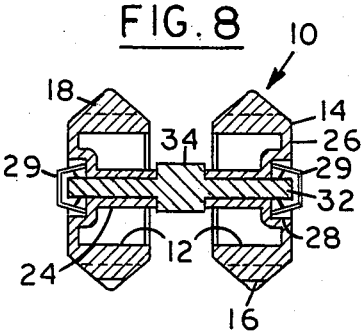
FIG. 8 is a similar section including axle stubs extending integrally from the chassis.
Figure 2:
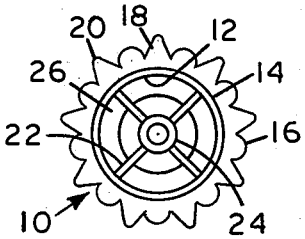
FIG. 2 is an elevational view of the spoke side of FIG. 1.
Figure 6:
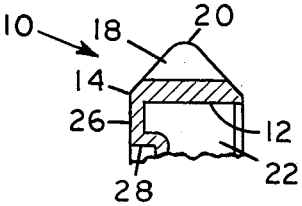
FIG. 6 is a section on line 6—6 of FIG. 4, showing a pyramid and peak.
Figure 5:
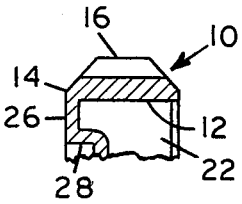
FIG. 5 is a section on line 5—5 of FIG. 4, showing a curved ridge.
Figure 4:
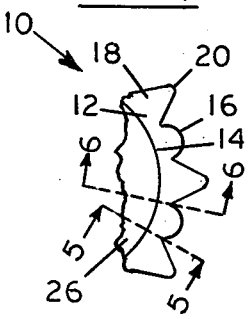
FIG. 4 is a side view of FIG. 3.
Figure 3:
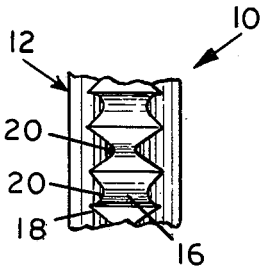
FIG. 3 is a fragmentary elevational view of the roller rim.
Figure 1:
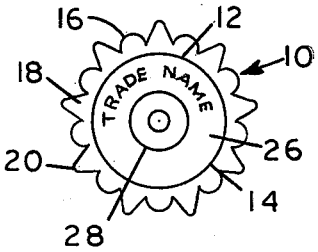
FIG. 1 is an elevational view of the disk face side of the massage roller of this invention.

The stub axles 32 are integrally formed with and extend from opposite sides of the frame chassis 34. The handle frame 36 is shaped somewhat like a capital letter D lying on its flat side, the flat bottom side providing the chassis 34. Circular bearing flats 38 are provided on the outer surface of the chassis 34 and protrude slightly above, as apparent in FIG. 10.

Extending outwardly and upwardly from opposite ends of chassis 34 are stanchions 40 integrally connected to opposite ends of a curved handle 42 having four finger-receiving recesses 44 on its underside, providing a hand-fitting handle.

Each of the four elongate portions 34, 40 and 42 of handle frame 36 are provided with lightening grooves 46 on their opposite sides. This preferred handle frame 36 thus provides means for journaling four massage rollers thereon, although it will be obvious that other handle frames could be provided for journaling any desired numbers of massage rollers thereon, from one up to, maybe, a dozen, more or less. Thus, the hand roller massage device 48 of this invention may be made with various numbers of massage rollers thereon, but in its preferred form will have four massage rollers.

OPERATION OF THE INVENTION

In operation, the operator's hand grasps the handle 42 and curls his fingers about the finger recesses 44, thus securing a firm grip on this hand massage roller device 38. He then rolls the massage rollers 10 over the desired areas of the human body, his or her own body or another person's body. This will massage and tone the flesh, kneading the skin and underlying flesh and fat and "cellulite". "Cellulite", the ugly protruding bulges on the human body, generally consists of an accumulation of gel-like substance made up of fat, water and wastes, trapped in lumpy, immovable pockets just beneath the skin. These pockets act like sponges that can absorb large amounts of water and blow up and bulge out, resulting in ripples and flabbiness, which most people cannot lose with the usual regime of diet and exercizes. The presence of cellulite is shown by pressing the tissues between thumb and index finger, or between the palms of both hands. If the skin ripples and looks like an orange peel, cellulite is present.

When the handle massage roller device 48 of this invention is used, the curved ridges 16 and pyramids 18 and their peaks knead and roll the cellulite lumps, breaking them up so that they are absorbed by the circulatory system and gradually disappear. In addition, this massage device tones the muscles and skin and improves the health thereof.

ABSTRACT OF THE DRAWING

In the drawing, like numbers refer to like parts, and for the purposes of explication, set forth below are the numbered parts of the improved HAND ROLLER MASSAGE DEVICE of this invention.

| Ref. No. | | Shown in FIGS. |
|---|---|---|
| 10 | massage roller | 1–9 |
| 12 | peripheral rim | 1–9 |
| 14 | peripheral edges | 1–9 |
| 16 | curved transverse ridges | 1–5, 7, 8, 9 |
| 18 | rectangular base pyramid | 1–4, 6, 7, 8, 9 |
| 20 | pyramid peak | 1–4, 6, 7, 8, 9 |
| 22 | spokes | 2–6 |
| 24 | hub | 2, 7, 8 |
| 26 | outer disk face | 1, 2, 4, 5, 6, 7, 8, 9 |
| 28 | nut recess in 26 | 1, 5–9 |
| 29 | cap nut | 1, 7, 8, 9 |
| 30 | one piece axle | 7, 9, 11 |
| 32 | axle stubs | 8 |
| 34 | chassis | 7–11 |
| 36 | handle frame | 9, 10, 11 |
| 38 | bearing flats | 11 |
| 40 | stanchion | 9, 10, 11 |
| 42 | curved handle | 9, 10, 11 |
| 44 | finger recesses | 9, 10, 11 |
| 46 | lightening grooves | 9, 10, 11 |
| 48 | hand roller massage device | 9 |

Although this invention has been described in considerable detail, such description is intended as being illustrative rather than limiting, since the invention may be variously embodied.

Having thus set forth the nature of this invention, What is claimed is:

1. A massage roller means (10) comprising a wheel-like roller member (10) having a somewhat broad peripheral rim (12), said rim (12) having alternate spaced-apart transverse projecting ridges (16) curved in peripheral cross-section, and intermediate rectangular base pyramid shaped ridges (18) extending outwardly therebetween, in combination with a handle frame (36) having a journal means (30, 32) on which said massage roller means (10) is journaled, said pyramid ridges (18) having their peaks (20) extending beyond a plane tangent to the two adjacent curved ridges (16).

2. A massage roller means comprising a wheel-like roller member (10) having a somewhat broad peripheral rim (12), said rim (12) having alternate spaced-apart transverse projecting ridges (16) curved in peripheral cross-section, and intermediate rectangular base pyramid shaped ridges (18) extending outwardly therebetween said rim (12) tapering from its opposite edges (14) toward said pyramid peaks (20), in combination with a handle frame (36) having a journal means (30, 32) on which said massage roller means (10) is journaled.

3. A massage roller means comprising a wheel-like roller member (10) having a somewhat broad peripheral rim (12), said rim (12) having alternate spaced-apart transverse projecting ridges (16) curved in peripheral cross-section, and intermediate rectangular base pyramid shaped ridges (18) extending outwardly therebetween, in combination with a handle frame (36) having a a journal means (30, 32) on which said massage roller means (10) is journaled, said handle frame (36) having a chassis (34), said journal means comprising axle means (30, 32) on said chassis (34), said handle frame (36) being shaped somewhat like a capital letter D lying on its flat side, said flat side providing said chassis (34).

4. The combination of claim 3, said chassis (34) being elongate, said axle means (30, 32) extending from opposite sides of both ends of said elongate chassis (34), there being a massage roller means (10) journaled on each said axle means (30, 32), said D like handle frame (36) providing a top curved handle portion (42) extending away from said elongate flat side chassis portion (34) and also providing stanchion portions (40) connecting the ends of said chassis portion (34) to the ends of said handle portion (36).

5. The combination of claim 3, said handle (42) having finger receiving recesses (22) on its underside.

6. The combination of claim 3, said handle frame (36) having longitudinal lightening grooves (46) extending along opposite sides of its elongate portions.

7. The combination of claim 4, both said roller means (30, 32) and said handle frame (36) being of ridged molded plastic.

8. The combination of claim 3, said axle means (32) being integrally molded with said chassis (34).

9. The combination of claim 3, said axle means (32) being integrally molded with and extending from both ends of said chassis (34), said chassis being elongate.

10. The combination of claim 3, said axle means (30, 32) extending transversely to and secured to each end of said chassis (34), said chassis being elongate.

11. The combination of claim 10, said axle means (30) being of metal.

* * * * *